United States Patent [19]

Katayama et al.

[11] 4,249,668

[45] Feb. 10, 1981

[54] ENVELOPE FOR CAMERA TUBE

[75] Inventors: Mitsumasa Katayama, Takatsuki; Masayasu Suemitsu, Nagaokakyo, both of Japan

[73] Assignee: Matsushita Electronics Corporation, Kadoma, Japan

[21] Appl. No.: 808,275

[22] Filed: Jun. 20, 1977

Related U.S. Application Data

[63] Continuation of Ser. No. 546,031, Jan. 31, 1975, abandoned.

[51] Int. Cl.[3] ..... H01K 1/30

[52] U.S. Cl. ..... 220/2.1 R; 220/355

[58] Field of Search ..... 220/2.1 A, 2.1 R, 2.3 A, 220/355, 352, 82 A

[56] References Cited

U.S. PATENT DOCUMENTS 3,165,227 1/1965 Crowell et al. ..... 220/355

*Primary Examiner*—Willis Little

*Attorney, Agent, or Firm*—Stevens, Davis, Miller & Mosher

[57] ABSTRACT

An envelope for a camera tube comprising a rectilinear bulb having a stem-sealing portion at one opening end rim thereof is provided with a thick portion at the other opening end thereof, the thick deformed portion is formed by melting the other opening end portion itself, a face plate being hermetically attached to the thick deformed portion by means of an indium ring.

2 Claims, 4 Drawing Figures

ENVELOPE FOR CAMERA TUBE

This is a continuation of application Ser. No. 546,031 filed Jan. 31, 1975, now abandoned.

The present invention relates to an envelope for a camera tube and a method for fabricating the same.

Generally, the envelope for a camera tube comprises a rectilinear tube with a stem sealing portion at one opening end thereof and a face plate hermetically mounted on the other opening end by means of an indium ring. If the wall of the rectilinear bulb is thin, however, it becomes difficult to maintain the high-hermetic property of the camera tube. According to the present invention, a thick deformed portion is formed on the rim of the other opening end of the rectilinear bulb by melting the rim itself in order to improve the hermetic property of the thin-wall rectilinear envelope of the camera tube.

Accordingly, an object of the present invention is to provide an envelope for a camera tube having a high-hermetic property.

Another object of the invention is to provide an envelope for a camera tube having a thin-wall rectilinear bulb wherein there is provided a high-hermetical structure between the bulb and the face plate.

Still another object of the invention is to provide a highly hermetic envelope for a camera tube which is capable of being fabricated with very simple and economic ways or means.

A further object of the invention is to provide a method for fabricating the above-mentioned highly hermetic envelope for a camera tube.

The envelope for the camera tube according to the present invention is characterized in that the envelope, comprising a rectilinear bulb having a stem-engaging portion on the rim of one opening end and a face plate hermetically attached to the rim of the other opening end by means of an indium ring, is provided with a thick deformed portion at the other opening end by melting the rim of the other end itself, so that the face plate can be hermetically attached to the thick deformed portion by means of an indium ring in order to achieve a superior hermetic engagement between the rectilinear bulb and the face plate.

The above and other objects, features and advantages will become more apparent by referring to the following detailed description taken in connection with the accompanying drawings, in which.

Figure 1:
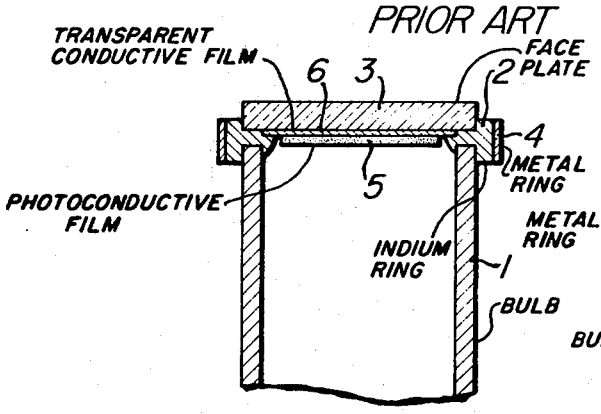
FIG. 1 PRIOR ART
FIG. 1 is a partly cut-away cross-sectional view showing a conventional envelope for a camera tube.

Generally, the envelope for a camera tube such as a vidicon camera tube comprises, as shown in FIG. 1, a rectilinear bulb 1, to be hermetically engaged with an electron-gun assembly, having a face plate 3 hermetically attached to one opening rim thereof by means of an indium ring 2. The electrical terminals of a photoconductive film 5 are guided through this indium ring 2 which is surrounded by a metal ring 4, to the metal ring 4. At the same time the indium ring 2 acts as a sealing material. Reference numeral 6 shows a transparent conductive film.

The end surface of the rectilinear bulb 1 opposite to the face plate 3 with the indium ring 2 positioned between the end surface and the face plate 3 is mirror-finished and bevelled prior to being sealed with the indium ring 2, so as to be gas-tightly bonded to the indium ring 2 of the sealing solder. If it is desirable that the envelope for a camera tube with such a construction have a superior hermetic property, it is necessary that the wall of the rectilinear bulb 1 be comparatively thick. A small camera tube which has been recently developed, however, requires a thin-wall rectilinear bulb.

The present invention, which is intended to meet such a demand, will be explained below with reference to the embodiments shown in the accompanying drawings.

Figure 2:
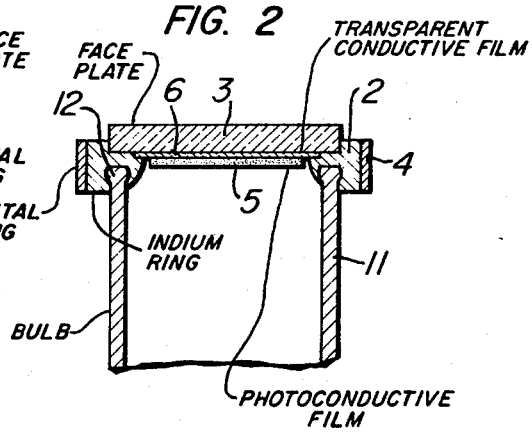
FIG. 2 is a cross-sectional view of the essential parts of the envelope for the camera tube according to the present invention.

Referring to FIG. 2, the rectilinear bulb specifically shown by reference numeral 11 is provided with a roundish thick deformed portion 12 on an opening end at the face plate side thereof, which thick deformed portion 12 is engaged with the indium ring 2 over a comparatively large area. The thick deformed portion 12 is obtained by fusing the rim of the one opening end of the rectilinear bulb 11 which is cut to a given length beforehand. In order to provide a flat end surface of the deformed portion 12, the end is preferably pressed at the final stage of fusing.

Figure 3:
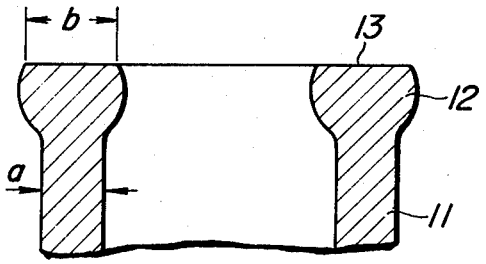
FIG. 3 is a diagram showing an enlarged cross-sectional view of the end rim of the rectilinear bulb illustrated in FIG. 2.
Figure 4:
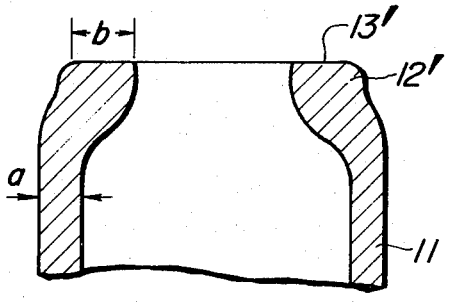
FIG. 4 is a cross-sectional view showing a modification of the embodiment of FIG. 3.

Such processes will be explained with reference to FIG. 3. The rectilinear bulb 11 has the thick deformed portion 12 at one of its ends. The end surface 13 of the portion 12 is smoothed, and preferably mirror-finished, the wall thickness b at the end surface 13 being larger than the thickness a of the wall of the rectilinear bulb itself. The thick deformed portion 12 may be formed inwardly of the bulb, namely, in such a direction as to render the radius of the bulb smaller, as shown in FIG. 4, in which case the end surface 13 is similarly smoothed and preferably mirror-finished as in the preceding case.

It will be seen from the foregoing description that according to the present invention a thick deformed portion is provided on the rim of an opening end at the face plate side of the rectilinear bulb by the melting of the rim itself in order to enlarge the area of bulb in contact with the indium ring. In this way, it is obtainable to have the same high-hermetic condition as if a rectilinear bulb with a thick wall over the whole length thereof is attached to the face plate. Further, the polishing and facing work are reduced or totally eliminated, thus obviating the likelihood of the edge of the rectilinear bulb being chipped or cracked. The invention finds an especially advantageous application to the envelope for a small camera tube.

What is claimed is:

1. An envelope for a camera tube comprising a thin-wall rectilinear bulb, a face plate, an indium ring sealed to said face plate and a metal ring surrounding said indium ring, said rectilinear bulb having one opening end thereof embedded in the wall portion of said indium ring, the improvement wherein said rectilinear bulb is provided with a deformed portion at said one opening end, said deformed portion being thicker than the rest of said rectilinear bulb and completely embedded in the wall portion of said indium ring, the surface of said deformed portion at said one opening end being flat and said deformed portion being increased in thickness substantially equally in the inward and outward directions of said thin-wall rectilinear bulb thereby providing a relatively large hermetic seal surface area between said thin-wall rectilinear bulb and said face plate, said indium ring being in pressure contact with the deformed portion of the rectilinear bulb so that the annular skirt of said indium ring has an inwardly directed bulge portion which is engaged with the downwardly shoulder of the peripheral portion of said bulb.

2. An envelope for the camera tube as set forth in claim 1, wherein said end surface is smoothed.

* * * * *